United States Patent [19]

Stefanski

[11] Patent Number: 4,815,729

[45] Date of Patent: Mar. 28, 1989

[54] FINGER EXERCISE DEVICE

[76] Inventor: Edwin Stefanski, 8145 W. Charmaine, Norridge, Ill. 60656

[21] Appl. No.: 103,937

[22] Filed: Oct. 2, 1987

[51] Int. Cl.[4] ..... A63B 21/30

[52] U.S. Cl. ..... 272/67; 272/139

[58] Field of Search ..... 272/67, 68, 125, 126, 272/135–139, 142, 143; 128/26, 133, 134; 2/161 A

[56] References Cited

U.S. PATENT DOCUMENTS

| | | | |
|---|---|---|---|
| 1,126,938 | 2/1915 | Barrett | 128/26 |
| 1,256,004 | 2/1918 | Finney | 128/26 |
| 3,347,547 | 10/1967 | Hynes | 272/67 |
| 3,612,521 | 10/1971 | Wendeborn | 272/67 |
| 4,105,200 | 8/1978 | Unger | 272/67 |

*Primary Examiner*—Richard J. Apley

*Assistant Examiner*—J. Welsh

*Attorney, Agent, or Firm*—Edward D. Manzo

[57] ABSTRACT

An elastomeric band-type exercise device is provided which is adjustable in length. The band includes an elongated strip of elastomeric material having one end secured to a coupling device. The other end of the strip is slidably threaded through the coupling device to define a desired length band whereafter the clamp is tightened to restrict movement of the strip and define an adjustable length endless band. A finger exercise device uses elastomeric material connected to elongated tubular members preferably in the form of a glove. The elastomeric material preferably is a band having a coupling device allowing the length of the band to be adjusted. A user exercises his or her fingers by stretching the band with the fingers.

5 Claims, 1 Drawing Sheet

FIG. 1
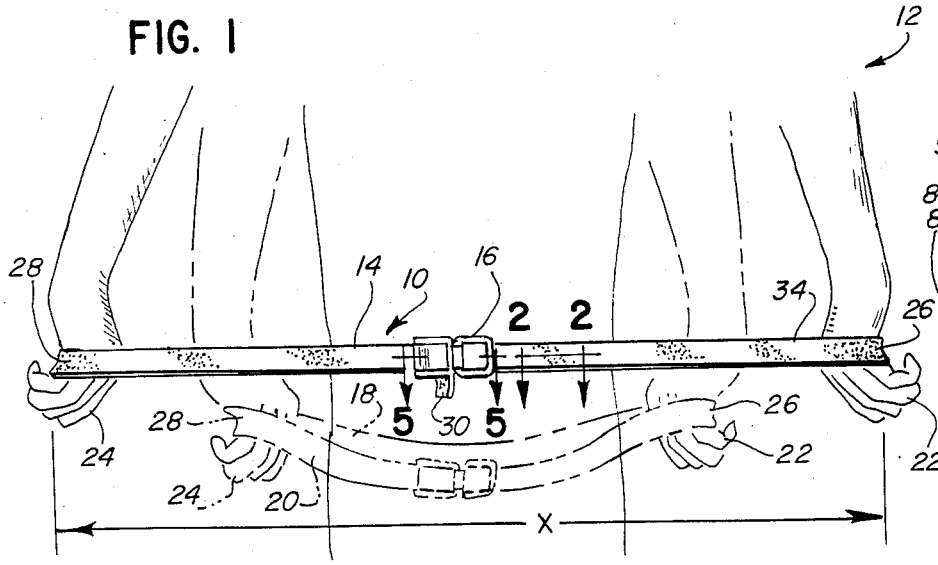
FIG. 7
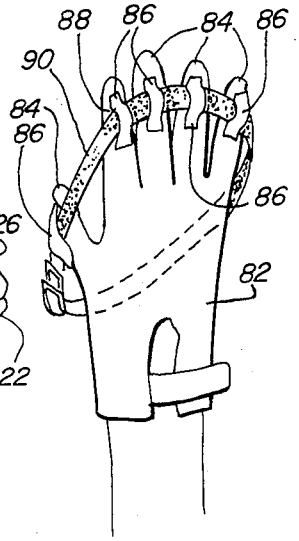
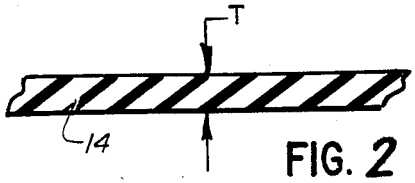
FIG. 2
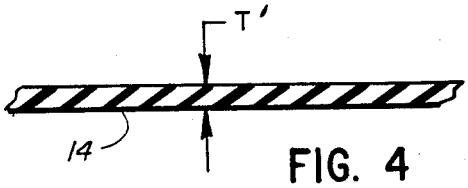
FIG. 4
FIG. 3
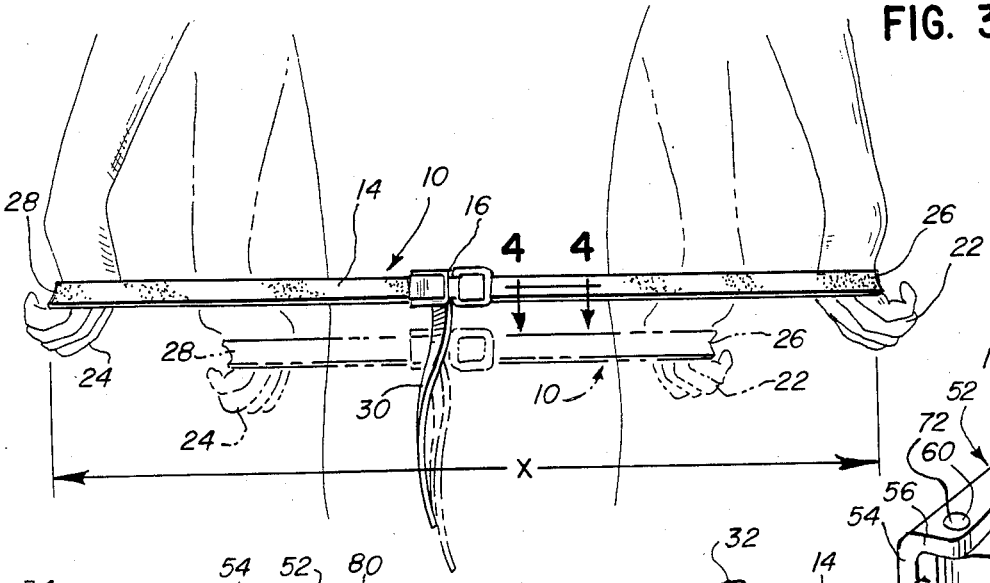
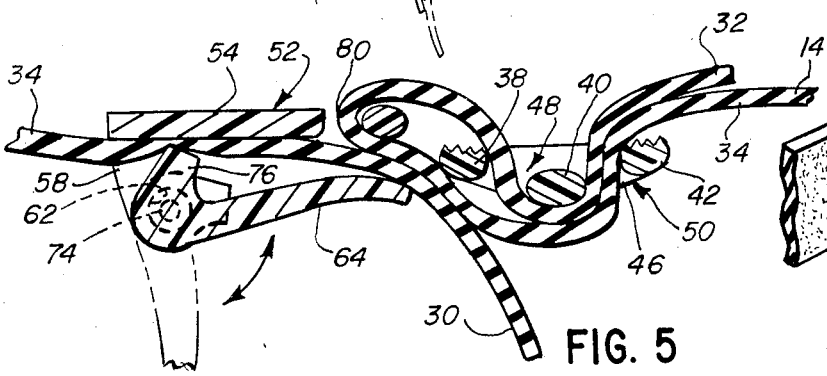
FIG. 5
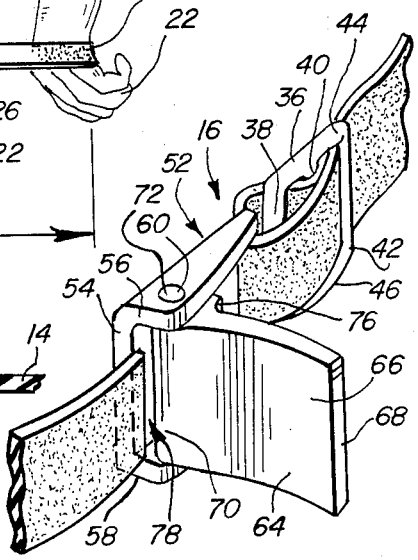
FIG. 6

FINGER EXERCISE DEVICE

FIELD OF THE INVENTION

This invention relates generally to exercise devices, and more particularly to an adjustable size and resistance band-type device.

BACKGROUND OF THE INVENTION

Numerous types of devices have been utilized in exercise programs to strengthen and rehabilitate various muscle groups in the body. For example, weight lifting is one of the more commonly practiced exercise routines. However, with weights there is a tendency to jerk the weights to complete a motion, and the weights have a tendency to swing muscles into position. Both of these factors reduce the effectiveness of the exercise and increase the risk of injury.

More recently, exercise programs have utilized elastic, or rubber, bands in their exercise programs. The band may be grasped, for example, between a user's hands and stretched to place the band under tension to provide resistance to movement. The tension is increased as the band is stretched. Such an exercise routine works to strengthen and tone muscles by stretching and contracting the muscles to overcome the force of the band.

In a complete exercise program, different size bands must be provided according to the particular exercise routine, and the desired tension or resistance to be provided thereby. Accordingly, a user must maintain a supply of various size bands in order to follow a complete fitness routine. The use of multiple bands increases the cost of exercising as well as the need for additional storage space for the multiple bands.

The present invention is intended to overcome these and other problems associated with band-type exercise devices.

It is an object of the present invention to provide an exercise device comprising an adjustable size and resistance band.

SUMMARY OF THE INVENTION

In accordance with the present invention, an exercise device according to the present invention provides an adjustable size and resistance to a user thereof.

Broadly, there is disclosed herein an exercise device that includes an elongated strip of elastic material having first and second end portions. A coupling device is secured to the first end portion and includes means for adjustably engaging the strip between the end portions to define an adjustable length belt. The belt provides an adjustable resistance to a user exerting opposing forces thereon.

In a preferred embodiment, the strip comprises an elongated strip of durable rubber which provides increased tension as the rubber material is stretched. One end of the strip is secured to the clamp using any known fastening method. The coupling device includes a slot through which the second end of the band is inserted whereby the coupling device may be slidably positioned on the strip between the two ends to form a belt or band. The coupling device includes a pivotal clamp including a gripping portion thereon which engages the strip to restrict movement between the clamp and the strip at a preselected position of the strip. The size and tension of the band are adjusted by pivoting the clamp to release engagement of the gripping portion with the strip and thereafter moving the coupling device relative to the strip and reapplying the clamp. Accordingly, the farther the coupling device is positioned from the first end of the strip, the larger the band and the lower the resistance provided.

The coupling device preferably is removably secured to the first end of the strip so that the band may be replaced without need for replacing the coupling device. Also, the coupling device may be utilized with various sized strips according to the needs of a particular user.

The present invention also provides a band-type exercise device for exercising one's hands which prevents the band from repositioning itself on one's fingers.

According to an alternative embodiment of the present invention, a conventional glove is provided with a strip of material secured, for example by sewing, to each finger portion of the glove on the outside thereof to define a loop. A rubberband is threaded through each loop to provide resistance for outward movement of the fingers to a user wearing the gloves.

Other features and advantages of the invention will readily by apparent from the specification and from the drawings.

BRIEF DESCRIPTION OF THE DRAWINGS

FIG. 1 is a partial perspective view of an exerciser utilizing the adjustable resistance exercise device according to the present invention;

FIG. 2 is a sectional view taken along lines 2—2 of FIG. 1;

FIG. 3 is a partial perspective view similar to that of FIG. 1, wherein the exercise device has been adjusted to a smaller size and to provide greater resistance;

FIG. 4 is a sectional view taken along lines 4—4 of FIG. 3;

FIG. 5 is a sectional view taken along lines 5—5 of FIG. 1;

FIG. 6 is a partial perspective view illustrating the coupling device of the exercise device of FIG. 1 in greater detail; and FIG. 7 is a perspective view of an alternative embodiment of the present invention.

DESCRIPTION OF THE PREFERRED EMBODIMENT

With reference to FIG. 1, an adjustable size and resistance band-type exercise device 10 according to the present invention is illustrated being used by a person 12 in an exercise routine. The exercise device 10 includes an elongated strip 14 of a resiliently expandable, or elastomeric, material joined at opposite ends thereof by a coupling device 16 to define an endless, continuous band. The exercise device 10 is illustrated in phantom in FIG. 1 prior to being placed under tension by the user 12 and in solid lines while under tension.

The device 10 includes an inside surface 18 and an outside surface 20. A user may take his or her two hands 22 and 24 and grasp the inside surface 18 of the device at points 26 and 28, respectively. In order to perform an exercise routine on the arms and upper body, the user moves his arms farther apart, as shown in solid line, thereby stretchably expanding the material 14. As the band 10 is expanded, it resists the opposing forces of the arms, requiring the muscles to stretch and contract to overcome a greater than average force. As the arms are moved close to one another, the resilience of the strip 14 causes it to contract to its normal size and the band 10 subsequently slackens, again, as shown in phantom.

If it is desirable to use a band providing a greater resistance, then the size of the exercise device 10 may be adjusted as illustrated in FIG. 3. The size is adjusted by repositioning the coupling device 16 on the strip 14 to provide a shorter length band 10, as is indicated by the increased length of an adjustable, or loose, end portion 30 of the strip in FIG. 3 relative to FIG. 1 Additionally, the shorter length of the band is illustrated by referring to the phantom portions of FIGS. 3 and 1 wherein the band hangs loosely in FIG. 1, but is relatively taut in FIG. 3 when the arms are approximately shoulder length apart.

In order to illustrate the capability of the exercise device 10 to provide adjustable resistance, reference is made initially to FIG. 1 wherein a relatively long band-type device 10 is stretched with the user's hands 22 and 24 being a distance X apart. Referring also to FIG. 2, a portion of the strip 14 is shown in cross section to be of thickness T. As is characteristic of any rubber material, when it is stretched, the thickness decreases thereby providing an increased resistance to further stretching.

With reference now to FIG. 3, the adjusted, relatively shorter device 10 is illustrated with a user again having his or her hands 22 and 24 the same distance X apart. Referring also to FIG. 4, a portion of the strip 14 is illustrated in cross section as being of a thickness T'. A side-by-side comparison of FIGS. 2 and 4 clearly show the thickness T of FIG. 2 to be greater than the thickness T' of FIG. 4. Thus, a greater resistance or tension is provided to a user by having the band device 10 adjusted to the relatively shorter length as illustrated in FIG. 3 relative to FIG. 1.

The strip 14 preferably is of a durable rubber material such as, for example, Epcar ® rubber. Epcar is a registered trademark of the B. F. Goodrich Company. The rubber should be sufficiently resilient and be able to withstand continual expanding and contraction thereof as would result from a typical exercise program.

Referring also to FIGS. 5 and 6, the strip 14 includes a secured end portion 32 in addition to the adjustable end portion 30, previously discussed. An elongated central portion 34 extends between the two end portions 30 and 32.

The coupling device 16 is of two-piece construction. A first piece, or clip, 36 secures one end of the strip 14 and includes three parallel leg portions 38, 40 and 42, joined by transverse end portions 44 and 46, to define a generally figure eight configuration having a pair of parallel slits 48 and 50 between adjacent leg portions 38 and 40, and 40 and 42, respectively. Such clips are available from Fastex division of Illinois Tool Works, Inc., for example.

The second piece of the coupling device 16 adjustably secures a portion of the strip 14 in a location adjacent to clip 36, as seen in FIG. 6. This second piece comprises a clamping element 52 including a generally rectangular base portion 54 having a pair of opposed parallel upturned side walls 56 and 58. Opposed, facing apertures 60 and 62 are provided in side walls 56 and 58, respectively. A pivotal clamp 64 includes a contoured portion 66 disposed between a distal end portion 68 and a pivotal end portion 70. Outwardly extending tabs 72 and 74 are provided along opposite side walls at the pivotal end 70. The tabs 72 and 74 are received in the apertures 60 and 62, respectively. The clamp 64 also includes a turned gripping portion 76 extending generally perpendicularly from the contoured portion 66 at the pivotal end 70. Accordingly, a variable sized slot 78 is formed between the base 54 of clamping element 52 and clamp 64. The size of the slot 78 is dependent upon the pivotal position of the clamp 64. An elongated opening 80 is provided in the base 54 extending between the side walls 56 and 58 opposite the end where the clamping element 62 is pivotally secured. Such clamps are available, for example, from Fixfabriken Goteborg of Sweden, known as "Fixlock 320".

The secured end portion 32 of the strip 14 is removably secured to the coupling device 16 as is illustrated particularly in FIG. 5. The end portion 32 is threaded upwardly through slot 50 of clip 36, then downwardly through slot 80 of clamping element 52, then turned back and upwardly through slot 48, and finally is turned back, downwardly through slot 50. When the end portion 32 is pulled tightly, the strip 14 is securely attached to the coupling device 16 in a relatively fixed manner.

With the clamp 64 in the raised position as shown in FIG. 6, and in phantom in FIG. 5, the spacing between the clamp 64 and the base portion 54 is at its greatest amount and is of a width greater than the width of the strip 14 in its unstretched state. Accordingly, the adjustable end portion 30 of strip 14 may be inserted through slit 78, and the clamping element 52 be slidably positioned to provide a desired band length. Thereafter, the clamp 64 is pivotally moved downwardly as shown by the arrow in FIG. 5, until the gripping portion 76 clamps the central portion 34 of the strip at the selected position between the gripping portion 76 and the base 54 to restrict movement between the clamping element 52 and the strip 14. The elasticity of the strip 14 effectively locks the clamp 64 in position when it is fully depressed.

Consequently, the length of the band device 10 may be adjusted by raising the clamp 64 and slidably repositioning the central portion 34 of strip 14 in slot 78. Subsequently, the clamp 64 must again be depressed to the locked position shown in solid line in FIG. 5.

By using the two-piece coupling device as shown, when a broken or worn-out flexible strip 14 need be replaced, it can be simply removed and disposed of without necessity for replacing the coupling device 16. Moreover, bands of differing widths and thickness may be utilized with a single size coupling device 16, provided the slot 78 is large enough when the clamp 64 is released to permit movement of the strip 14, and small enough when the clamp 64 is depressed to effectively grip the strip 14.

Alternatively, a two-piece coupling device could be combined into a single piece by making the base portion 54 longer and adding a second parallel slit therein with a fixed end portion 32 of strip 14 being threaded therethrough in a similar manner as with the two-piece construction described and illustrated.

Similarly, an adjustable band exercise device could be provided utilizing a coupling device 16 comprising only the clip portion 36. With such a construction, the strip fixed end portion 32 would either be secured directly to the middle leg 40, or be wrapped around the middle leg 40 and be secured to itself by any known means such as an adhesive or a fastener. Thereafter, the adjustable end portion 30 could be inserted upwardly through the first slot 48 and then downwardly through the second slot 50 much as in a conventional lap-type belt.

According to the present invention, the particular length of strip 14 utilized may be of a length to provide for substantially all desired exercises. The strip could be long enough to provide a band extending from the bottom of one's foot to extend above one's head. By appropriately adjusting the size of the band, the device 10 could be utilized where much shorter bands are desired without the need for utilizing two separate bands. Therefore, in addition to providing for multistages of an exercise program with adjustable resistance, the device 10 also acts as an adjustable size device to provide for exercising different portions of one's body.

Referring to FIG. 7, an alternative embodiment of the present invention is illustrated. According to the alternative embodiment, a glove 82 includes tubular finger portions 84 for each finger and thumb. The glove 82 may be, for example, similar to a conventional golf glove or batting glove. An elongated strip 86 of, for example, fabric or leather, has its opposite ends secured to each respective finger portion 84 to define a loop 88 therebetween. The strip 86 may be secured to the finger portion by sewing the two together, or with a suitable adhesive. The loop 88 is similar to a conventional pants belt loop. An endless band of elastomeric material can be threaded through each loop 88. The band may be a conventional rubberband. When the glove 82 is worn on the hand of a user, the rubberband provides a resistive force when the fingers are moved outwardly against the force of the band placing the band under tension. The loops 88 prevent the band from sliding down towards a user's wrist as the ends of the fingers are moved apart which might happen if no such loops 88 were provided.

Preferably, according to the alternative embodiment, an adjustable length resistance band 90 is used, as described previously with reference to FIGS. 1–6. Typically, such a band would utilize a strip of shorter length and width than might be used, for example, in exercising other portions of one's upper body. Such an adjustable band 90 may be made longer or shorter, to decrease or increase, respectively, the resistance provided to a user in exercising the hand and fingers, as discussed above.

Thus, the invention broadly comprehends an exercise device for providing an adjustable size and resistance to a user thereof.

The foregoing disclosure of the preferred embodiments is illustrative of the broad inventive concepts comprehended by the invention.

I claim:

1. An exercise device for exercising the hand and fingers of a user comprising:

a plurality of elongated tubular members of a size to fit over the fingers of a user;

a plurality of loops on said tubular members, each loop being configured to engage a strip of elastomeric material;

a strip of elastomeric material threaded through said loops to provide a resistive force to a user wearing said tubular members when the fingers of the user place the band under tension;

a coupling device secured to a first end portion of said elastomeric strip, said coupling device adjustably engaging a portion of said elastomeric strip between said first end portion and a second end portion thereof to define an adjustable length band of elastomeric material which may be expanded by a user exerting opposing forces with the fingers.

2. The exercise device of claim 1 wherein the coupling device includes a clip through which one end portion of said strip is threaded.

3. An exercise device for exercising the hands and fingers of a user comprising:

a glove having finger portions;

a strip of material for each finger portion of said glove, each said strip of material being secured to its finger portion to define a loop;

an elongated strip of elastomeric material defining opposite ends and an elongated central portion therebetween; and a gripping device secured to said elongated strip adjacent one of said ends thereof, and means for adjustably engaging the gripping device with said strip at the central portion thereof to define a band wherein the size and resistance of the band are adjustable according to the longitudinal position where said gripping device is adjustably secured to the elongated central portion of said strip.

4. The exercise device of claim 3 wherein said means for adjustably engaging includes a pivotal clamp.

5. The exercise device of claim 3 wherein said gripping device includes a base portion and a clamp pivotally secured to said base portion and positioned to hold said elongated strip to said base portion.

* * * * *